US011247877B2

(12) United States Patent
Guymon et al.

(10) Patent No.: US 11,247,877 B2
(45) Date of Patent: Feb. 15, 2022

(54) OFFSHORE SHIP-TO-SHIP LIFTING WITH TARGET TRACKING ASSISTANCE

(71) Applicant: J. Ray McDermott S.A., Houston, TX (US)

(72) Inventors: David Lee Guymon, Katy, TX (US); Matthew McLean, Houston, TX (US); Rinov Herawan, Katy, TX (US)

(73) Assignee: J. RAY MCDERMOTT, S.A., Houston, TX (US)

( * ) Notice: Subject to any disclaimer, the term of this patent is extended or adjusted under 35 U.S.C. 154(b) by 0 days.

(21) Appl. No.: 15/908,479

(22) Filed: Feb. 28, 2018

(65) Prior Publication Data

US 2018/0244505 A1 Aug. 30, 2018

Related U.S. Application Data

(60) Provisional application No. 62/464,942, filed on Feb. 28, 2017.

(51) Int. Cl.
*B66C 23/53* (2006.01)
*B66C 13/04* (2006.01)
(Continued)

(52) U.S. Cl.
CPC ..... *B66C 23/53* (2013.01); *B63B 27/10* (2013.01); *B63B 27/14* (2013.01); *B63B 27/30* (2013.01);
(Continued)

(58) Field of Classification Search
CPC ..... B63B 27/14; B63B 27/10; B63B 27/30; B63B 2017/0072; B63B 2734/00; B66C 23/53; B66C 23/52; B66C 13/18; B66C 13/04; B66C 15/04; B66C 13/02; B66C 13/46
(Continued)

(56) References Cited

U.S. PATENT DOCUMENTS 3,799,505 A * 3/1974 Duncan ..... B66C 13/02 254/291
4,147,330 A 4/1979 Eik
(Continued)

FOREIGN PATENT DOCUMENTS

CN 104370229 B 8/2016
GB 2163402 A 2/1986
(Continued)

OTHER PUBLICATIONS

PCT/US2018/020203, International Search Report dated May 8, 2018, 3 pages.
(Continued)

*Primary Examiner* — Angelina Shudy
*Assistant Examiner* — Mohamed Abdo Algehaim
(74) *Attorney, Agent, or Firm* — Patterson + Sheridan, LLP

(57) ABSTRACT

Aspects of the disclosure include apparatus for and methods of facilitating transfer of objects using a crane. Disclosed apparatuses include a target tracking device mounted on or near a crane at a first location, and a target located near a landing location for the object. The target tracking device and the target facilitate real time determination of relative motion between the two locations. Methods of using the same are also disclosed.

21 Claims, 8 Drawing Sheets

(51) Int. Cl.

| | |
|---|---|
| ***B63B 27/30*** | (2006.01) |
| ***B66C 15/04*** | (2006.01) |
| ***B63B 27/10*** | (2006.01) |
| ***B66C 13/18*** | (2006.01) |
| ***B66C 23/52*** | (2006.01) |
| ***B66C 13/02*** | (2006.01) |
| ***B63B 27/14*** | (2006.01) |
| ***B63B 17/00*** | (2006.01) |

(52) U.S. Cl.
CPC ..... *B66C 13/02* (2013.01); *B66C 13/04* (2013.01); *B66C 13/18* (2013.01); *B66C 15/04* (2013.01); *B66C 23/52* (2013.01); *B63B 2017/0072* (2013.01)

(58) Field of Classification Search
USPC ..... 701/50
See application file for complete search history.

(56) References Cited

U.S. PATENT DOCUMENTS

| | | | | |
|---|---|---|---|---|
| 6,115,129 | A | 9/2000 | Holmquist et al. | |
| 6,182,843 | B1 | 2/2001 | Tax et al. | |
| 6,826,452 | B1 * | 11/2004 | Holland | B66C 1/663 318/566 |
| 8,681,317 | B2 | 3/2014 | Moser et al. | |
| 9,041,595 | B2 * | 5/2015 | Cameron | G01S 13/46 342/118 |
| 9,815,668 | B2 * | 11/2017 | Morath | B66C 13/16 |
| 9,849,944 | B2 * | 12/2017 | Foo | B63B 27/30 |
| 9,902,596 | B2 | 2/2018 | Morrow et al. | |
| 10,308,327 | B1 * | 6/2019 | Van Loon | B63B 25/28 |
| 2006/0191457 | A1 * | 8/2006 | Murphy | B63B 21/04 114/253 |
| 2007/0050115 | A1 * | 3/2007 | Discenzo | B66C 13/063 701/50 |
| 2007/0289931 | A1 * | 12/2007 | Henriksson | B66C 13/085 212/274 |
| 2008/0229524 | A1 * | 9/2008 | Watchorn | B63B 27/143 14/69.5 |
| 2012/0296519 | A1 * | 11/2012 | Eberharter | B63B 27/10 701/34.4 |
| 2013/0120577 | A1 * | 5/2013 | Austefjord | B66C 13/02 348/148 |
| 2013/0154869 | A1 | 6/2013 | Cameron et al. | |
| 2013/0245817 | A1 * | 9/2013 | Schneider | B66C 13/02 700/228 |
| 2013/0345857 | A1 * | 12/2013 | Lee | B66C 13/48 700/229 |
| 2014/0107971 | A1 * | 4/2014 | Engedal | B66C 13/02 702/150 |
| 2014/0284296 | A1 * | 9/2014 | Appels | B66C 13/48 212/276 |
| 2015/0112638 | A1 * | 4/2015 | Morrow | B66C 13/46 702/182 |
| 2015/0360887 | A1 * | 12/2015 | Maij | B63B 27/10 414/803 |
| 2015/0375836 | A1 * | 12/2015 | van der Tempel | B63B 27/14 701/22 |
| 2016/0063709 | A1 * | 3/2016 | Booij | B66C 23/52 348/142 |
| 2016/0376848 | A1 * | 12/2016 | Taraldrud | E21B 15/02 166/355 |
| 2017/0096196 | A1 * | 4/2017 | Foo | B63B 27/30 |
| 2017/0120991 | A1 * | 5/2017 | Wallin | B63B 27/30 |
| 2018/0312225 | A1 * | 11/2018 | Peleg | B63B 21/04 |
| 2018/0370775 | A1 * | 12/2018 | Gong | F15B 11/08 |

FOREIGN PATENT DOCUMENTS

| | | | |
|---|---|---|---|
| JP | S5953394 | A | 3/1984 |
| JP | H1036071 | A | 2/1998 |
| JP | 2013147173 | A | 8/2013 |
| JP | 2016-193706 | A | 11/2016 |
| KR | 10-2015-0027105 | A | 3/2015 |
| WO | 2010009570 | A1 | 1/2010 |
| WO | 2013015684 | A1 | 1/2013 |
| WO | 2015044898 | A1 | 4/2015 |
| WO | 2015087074 | A1 | 6/2015 |
| WO | 2018228809 | A1 | 12/2018 |

OTHER PUBLICATIONS

Australian Examination Report dated May 7, 2020 for Application No. 2018227805.
Tordal, Sondre Sanden et al., "Relative Vessel Motion Tracking using Sensor Fusion, Aruco Markers, and MRU Sensors," Modeling, Identification and Control, vol. 38, No. 2, pp. 79-93.
Chinese Office Action dated May 7, 2020 for Application No. 201880014145.3.
International Search Report and Written Opinion dated Aug. 5, 2020 for Application No. PCT/US2020/016527.
Australian Examination Report dated Jul. 8, 2020 for Application No. 2018227805.
Chinese Office Action dated Jan. 29, 2021 for Application No. 201880014145.3.
Canadian Office Action dated Sep. 21, 2020 for Application No. 3,053,477.
Korean Office Action dated Feb. 3, 2021 for Application No. 10-2019-7025837.
Australian Examination Report dated Oct. 19, 2020 for Application No. 2018227805.
Japanese Office Action dated Oct. 20, 2020 for Application No. 2019-547416.
Australian Examination Report dated Mar. 23, 2021 for Application No. 2018227805.
European Office Action dated Apr. 22, 2021 for Application No. 18710697.6.
Australian Notice of Acceptance dated May 12, 2021 for Application No. 2018227805.

* cited by examiner

| Working Radius [m] | Design SWL [t] = Hs 0m | Significant wave height | | | | | | |
|---|---|---|---|---|---|---|---|---|
| | | Hs 0.5m | Hs 1m | Hs 1.5m | Hs 2m | Hs 3m | Hs 4m | Hs 5m |
| | | Table for Derated loads [t] | | | | | | |
| 6.6 | 400.0 | 400.0 | 353.7 | 240.0 | Lifting not allowed | | | |
| 8.0 | 400.0 | 400.0 | 353.7 | 240.0 | | | | |
| 9.5 | 398.8 | 378.1 | 341.7 | 240.0 | | | | |
| 11.0 | 364.5 | 348.4 | 316.6 | 240.0 | | | | |
| 12.5 | 333.2 | 320.5 | 292.2 | 235.4 | | | | |
| 14.0 | 304.9 | 294.7 | 268.8 | 216.8 | | | | |
| 15.5 | 279.5 | 271.1 | 246.9 | 199.1 | | | | |
| 17.0 | 257.0 | 249.7 | 226.8 | 182.6 | | | | |
| 18.5 | 237.1 | 230.7 | 208.6 | 167.5 | | | | |
| 20.0 | 219.6 | 214.0 | 192.5 | 154.0 | | | | |
| 21.5 | 204.3 | 199.4 | 178.3 | 142.2 | | | | |
| 23.0 | 190.8 | 186.8 | 165.9 | 131.7 | | | | |
| 24.5 | 178.9 | 175.8 | 155.0 | 122.5 | | | | |
| 26.0 | 168.4 | 166.1 | 145.0 | 113.9 | | | | |
| 27.5 | 158.8 | 157.1 | 135.3 | 105.5 | | | | |
| 29.0 | 150.0 | 148.1 | 125.1 | 96.3 | | | | |
| 30.5 | 141.7 | 138.2 | 113.6 | 85.4 | | | | |
| 32.1 | 133.0 | 125.6 | 98.2 | 70.3 | | | | |

FIG. 7
( PRIOR ART )

OFFSHORE SHIP-TO-SHIP LIFTING WITH TARGET TRACKING ASSISTANCE

CROSS-REFERENCE TO RELATED APPLICATIONS

This application claims benefit of U.S. provisional patent application Ser. No. 62/464,942, filed Feb. 28, 2017, which is herein incorporated by reference.

BACKGROUND

Field

Embodiments of the present disclosure generally relate to apparatuses for, and methods of, facilitating transfer of objects using a crane.

Description of the Related Art

Ship-to-Ship Transfer (STS) operations are the transfer of cargo between seagoing ships positioned alongside each other, either while stationary or underway. This operation is typically performed utilizing a lifting device, usually a crane. As this operation is typically performed in the middle of the sea, the weather and sea state will cause both vessels to surge, sway, heave, pitch, yaw, and roll. Typically, both vessels are separated from each other and a relative horizontal distance therebetween is maintained using, for example, dynamic positioning, anchors, or ropes, among other devices. As such, the dynamic motions of each vessel are independent from one another.

While most dynamic movements can be controlled by providing a "safe zone" around the lifted product (e.g., adequate spacing to avoid inadvertent collisions), the vertical movement is still significant and thus can lead to hazardous situations when a load slams back to a vessel deck due to relative vessel movement. This "load slamming" can result in damage to the load/product and/or vessel. Due to this, STS operations are typically limited to favorable weather conditions to reduce the risks. In cases of unfavorable weather conditions which prevent STS operations, the cost of a particular operation is driven upwards due to both vessels being in stand-by until conditions improve to allow the operations to commence.

"Load slamming" risk is currently mitigated in some restricted cases by using a constant tension mode of the crane wherein a sensor is used to detect change in tension of the cable and reacts to maintain tension at a constant or near constant value. However, this feature is only available on some cranes and is limited to specific use cases and limited capacities.

Another conventional method of managing load slamming uses a derating chart to limit the load capacity of offshore cranes due to relative velocities between the crane vessel and the deck of a supply vessel or barge. The relative velocities are derived by wave height and the allowed loads are typically conservative, particularly since wave heights are often estimated visually by an operator, and therefore, not precise. A conventional derating chart, as shown in FIG. 7, is typically used to determine the derated load capacity for a given crane type. A derating chart provides allowed loads corresponding to an estimated wave height and lifting radius.

Other conventional techniques use active heave compensators (AHC) to address the relative motion between vessels. An AHC is a device used to compensate hook elevation according to real time calculation of motions collected from a motion reference unit (MRU) sensor located on each vessel. However, such techniques require the MRU sensors be installed on each vessel and information must be transmitted wirelessly therebetween. Such wireless data links are prone to interruption which reduces the reliability of the wireless MRU systems. Therefore, wireless MRU sensors are not able to reliably address the "load slamming" risk discussed above.

Therefore, what is needed is a new method and apparatus for facilitating transfer of objects with cranes, including but not limited to real time relative motion measurement for derating of the crane for load lifting operations.

SUMMARY

Aspects of the disclosure include apparatus for, and methods of, facilitating transfer of objects using a crane. Disclosed apparatuses include a target tracking device mounted on or near a crane at a first location, and a target located near a landing location for the object. The target tracking device and the target facilitate real time determination of relative motion between the two locations. Methods of using the same are also disclosed.

In one aspect, a method of performing a landing or lift-off operation between a first vessel having a crane thereon and a second vessel is provided. The method includes tracking a target located on the second vessel with a target tracking device positioned on the first vessel; determining a relative motion between the first and second vessel based on data produced by the target tracking device; and compensating for the relative motion between the first vessel and the second vessel in response to the data produced by the target tracking device.

In one aspect, a method of performing a landing or lift-off operation between a first vessel having a crane thereon and a second vessel is provided. The method includes tracking a target located on the second vessel with a target tracking device positioned on the first vessel; in response to the tracking, producing data that indicates: a distance between the target tracking device and the target; and a relative angle between a vertical axis and a line of sight between the target tracking device and the target; determining a relative motion between the first and second vessel based on the data produced by the target tracking device; and determining a lifting capacity of the crane based on the relative motion.

In another aspect, a system for performing a landing or lift-off operation includes a crane having an active heave compensator coupled thereto; a target tracking device; an optical target, the optical target configured to be tracked by the target tracking device; and a controller, the controller configured to receive data from the target tracking device, and in response to receiving the data, send instructions to the active heave compensator to provide active heave compensation.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of scope, as the disclosure may admit to other equally effective embodiments.

FIGS. 1B and 10 are enlarged partial views of FIG. 1A.

FIG. 7 illustrates a conventional derating chart used to facilitate lift-off and landing operations.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Aspects of the disclosure include apparatus for and methods of facilitating transfer of objects using a crane. Disclosed apparatuses include a target tracking device mounted at a first location, and a target located near location for the object to be lifted from or landed onto. The target tracking device and the target facilitate real time determination of relative motion between the two locations. Methods of using the same are also disclosed.

Figure 1A:
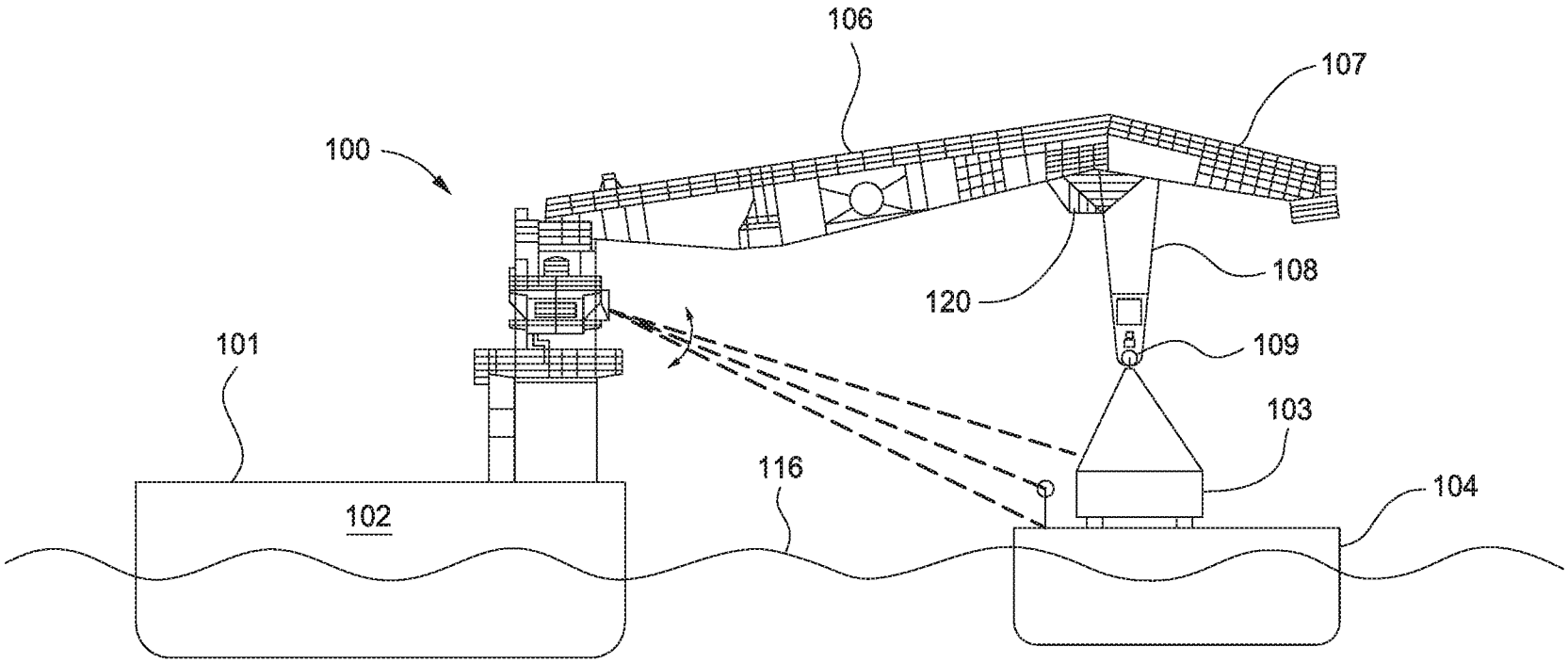
FIG. 1A schematically illustrates a crane transferring an object, according to one aspect of the disclosure.
Figure 1C:
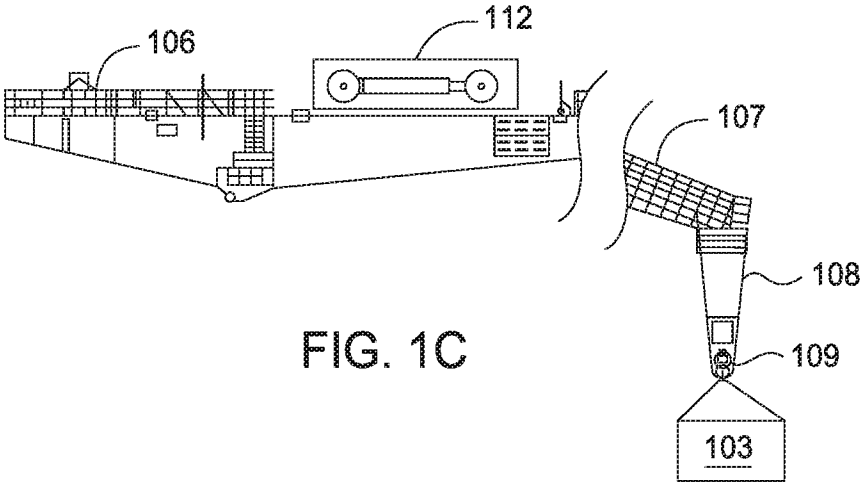
Figure 1B:
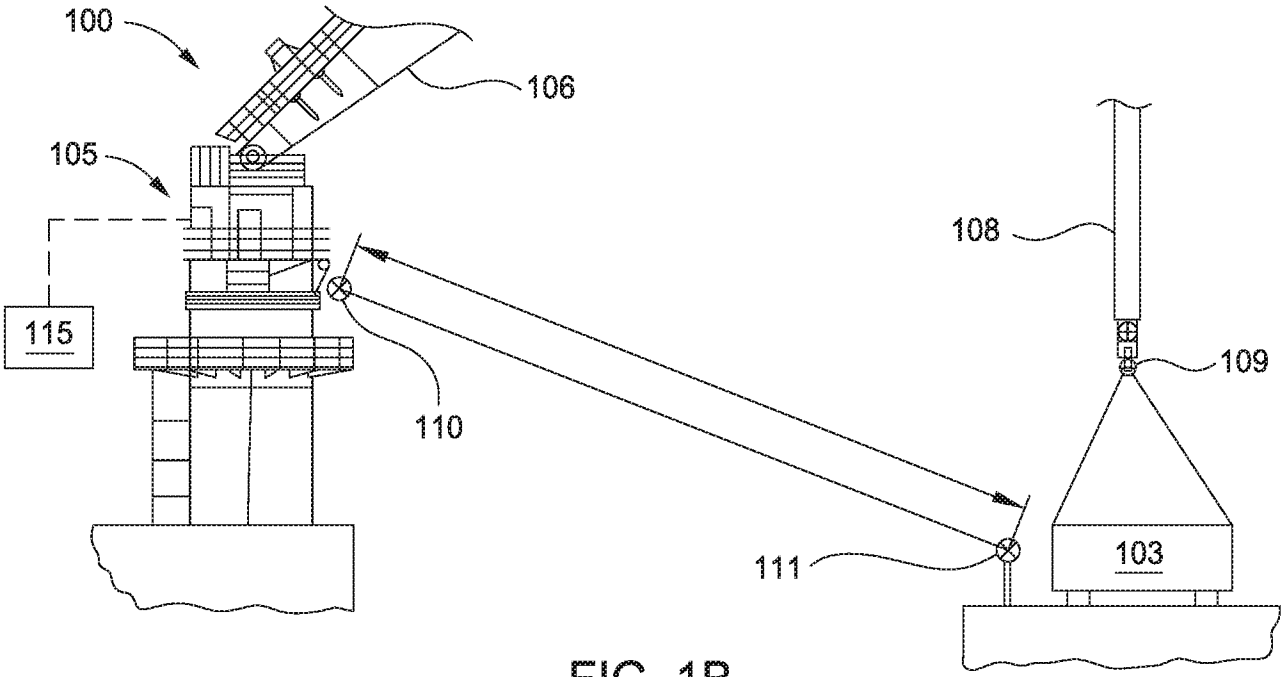

FIG. 1A schematically illustrates a crane 100 transferring an object 103, according to one aspect of the disclosure. FIGS. 1B and 10 are enlarged partial views of FIG. 1A. As illustrated, the crane 100 is positioned on a deck 101 of a first vessel 102 located in a body of water 116. The crane 100 is configured to position an object 103 on, or remove an object 103 from, a second vessel 104 located adjacent to the first vessel 102. The object 103 is alternatively referred to herein as the load. The crane 100 includes at least an operator cab 105, a boom 106, a jib 107, a hoist line 108, and a hook 109. The crane 100 may be mounted on a pedestal to facilitate rotational movement of the crane 100, or to facilitate coupling with the deck 101 of the first vessel 102. An optional carriage 120 travels along the boom 106 and the jib 107 to laterally move the hoist line 108 and the hook 109 coupled thereto.

To facilitate transfer of the object 103 by accounting for relative motion between the first vessel 102 (and thus, the crane 100) and the second vessel 104, a target tracking device 110 is utilized. The target tracking device 110 is an instrument that accurately measures the position of an optical target 111, which may be positioned on or adjacent to an object, such as object 103. The target tracking device 110 is generally mounted on the cab 105 of the crane 100 but other mounting locations, such as on the deck, may be used. The optical target 111 is mounted on the second vessel 104 near the object 103 (or near a location at which the object 103 is to be positioned). Thus, as the target tracking device 110 tracks the optical target 111, tracking of the second vessel 104 relative to the target tracking device 110 (and correspondingly, the crane 100 and the vessel 102) occurs. In one example, the optical target 111 is a spherically mounted retroreflector (SMR), which resembles a ball bearing with mirrored surfaces formed thereon. In another embodiment, the optical target 111 is an optical grid of alternating squares which are recognizable by the target tracking device 110. It is to be noted that other shapes, such as triangles or circles, which are distinguishable by the target tracking device 110 may be utilized for the optical grid. Further, the optical target 111 may also be a different type of marker which is recognizable by the target tracking device 110.

The target tracking device 110 is configured to determine a distance between the target tracking device 110 and the optical target 111. In addition, the target tracking device may also simultaneously determine an angle of a line of sight (e.g., a direct line between the target tracking device 110 and the optical target 111) relative to a vertical axis of the operator cab 105 or other reference axis.

In one example, servo motors within the target tracking device 110 continuously orient the target tracking device 110 towards the optical target 111 in response to relative movement therebetween. A trigonometric calculation is performed to calculate the height of the object 103 above the optical target 111 and the distance therebetween. The determination of the distance between the target tracking device 110 and the optical target 111, the distance between the object 103 and the optical target 111, and the angle of the line of sight of the target tracking device 110 to the optical target 111 relative to an axis, such as the axis of the cab 105, are used to determine relative motion between the first vessel 102 and the second vessel 104.

In another example, the target tracking device 110 determines a distance between the shapes of an optical grid used as the optical target 111. The shapes are distinguishable by the target tracking device 110. The distance between the shapes, or the sizes thereof, is used by the target tracking device 110 to determine distance therefrom. For example, a distance between the shapes may be known. The target tracking device 110 is configured to measure a distance between the shapes and relate the measured distance between the shapes to the known distance therebetween to determine the distance of the optical target 111 from the target tracking device 110.

The target tracking device 110 may also determine a rotational motion of the optical target 111. In one example, the target tracking device 110 determines relative rotation of the optical target 111 by determining distances between the objects used to form the optical grid of the optical target 111 and/or image matching images of the said optical grid to images of optical grids of a known relative rotation. The determined rotational motion of the optical target 111 can be used to determine the rotation of an object offset therefrom, such as the load 103 or a landing area on the deck of a vessel.

Processing of data, including performance of calculations, is performed by a controller 115 or other computing device. In one example, the controller 115 is located within the operator cab 105 and displays information to the operator on a display. The display may optionally be a touch-screen panel, allowing an operator to interact with the display, the controller 115, and the target tracking device. In yet another example, display may be a heads-up display (HUD).

The target tracking device 110 and the optical target 111 allow the relative velocity (e.g., a change in the measured position over a period of time) between the first vessel 102 and the second vessel 104 to be determined. The determination of relative velocity allows assessment as to whether the motion between the first vessel 102 and the second vessel 104 is within a specified operational range corresponding to particular lift, such as a given load and size thereof, thereby improving safety. Additionally, the relative velocity and/or the relative motion between the first vessel 102 and the second vessel 104 can be used to determine a derating factor of a crane and a lifting capacity thereof based upon to the relative motion.

Traditionally, heave compensators and associated systems act on the hoist or a cylinder in reeving of the hoist line 108. With reference to FIG. 10, the crane 100 includes an exemplary active heave compensator 112 representatively coupled to the boom 106. It is contemplated that the boom 106 may include an active heave compensator 112 integrated therewith, or that the boom may be retrofitted with an active heave compensator 112, as shown. The active heave compensator 112 may also be installed elsewhere, such as within the crane pedestal or even within the vessel 102, so as long as the active heave compensator 112 is in contact with the hoist line 108. The active heave compensator 112 includes one or more motors, hydraulic pumps, accumulators, and/or gas systems to facilitate active heave compensation during lifting operations. The active heave compensator 112 receives signals from the controller 115. The controller 115 instructs the active heave compensator 112 to perform adjustment operations, in response to data determined by the target tracking device 110 or data received or computed by the controller 115, to reduce relative movement between the object 103 and the second vessel 104 during a lifting operation. The operations performed by the active heave compensator 112 result in substantially synchronous movements between the object 103 and deck of the second vessel 104, particularly at the location of the optical target 111, thereby reducing or eliminating impact of the load, and increasing the available operational window for performing operations. For example, conventionally, load sizes for lifting are limited due to wave height of the body of water 116 which causes relative motion between the first vessel 102 and the second vessel 104. However, methods and apparatus herein allow for increased operational windows by allowing lifting of a load at increased wave heights (i.e., increased relative motion between two vessels) compared to conventional techniques. It is also contemplated that the active heave compensation may be accomplished by heave compensation operations of the hoist (i.e., winch) coupled to the hoist line 108 of the crane 100 in response to signals received from the controller 115.

It is to be noted that the target tracking device 110 may determine relative motion between the first vessel 102 and the second vessel 104 without active heave compensation being applied. For example, the target tracking device 110 can determine relative motion between the vessels to aid an operator in determining a derating factor of the lifting capacity of the crane 100 in relation to the determined relative motion. The derating factor may be determined by a control system automatically or may be determined by an operator using a derating chart based upon relative velocity and/or relative motion. Additionally, although the crane 100 and the vessel 102 are located in water, it is contemplated that the crane 100 may alternatively be located onshore or on a fixed offshore structure. In such examples, the crane 100 may be mounted on a mobile platform, such as a truck or a quay, or may be fixed in position. The crane 100 may also be mounted to a jack-up crane barge, a jack-up offshore platform, or a floating offshore platform.

It is also contemplated that targets other than the optical target 111 may be utilized according to implementations of the present disclosure. The optical target 111 may include other reflective materials, or may vary in size, quantity, and shape.

In other aspects, it is contemplated that more than one optical target may be utilized. In such an example, a second optical target, such a laser or an optical grid, can be output from additional sources with signatures, such as wavelengths or grid patterns, identifiable by the target tracking device 110. Such a configuration may be useful when an optical target 111 is to be placed in a hazardous environment, such as an area under a hanging load (e.g., directly beneath the object 103 during landing or lift-off). According to this embodiment, a person located on a working deck, such as the deck of the second vessel 104 could use an optical target source, such as a laser pointer, to direct the target tracking device 110 onto an optical target (e.g., the operator could "paint" a target to be recognized by the target tracking device 110). Once the target tracking device 110 recognizes the optical target, the position of the optical target is registered for future tracking by the target tracking device 110 and for viewing in a display of the operator cab 105. In another embodiment, the second target may be a series of coordinate points input into the system which are recognizable by the target tracking device 110.

Once a target is registered, the target can be stored by the memory of the system and thus does not require continued illumination with the laser pointer by an operator. For example, the target may be stored as an image to be image matched by the controller. Thus, the targets can be stored for operations beyond the immediate lift-off or landing operation. In doing so, the stored targets (viewable on a crane operator display, such as an HUD) may provide visual landmarks to which a crane operator can navigate the crane hook 109 or an object 103 suspended therefrom. Thus, the hook 109 can be guided into positions normally not navigable, or at least unnavigable without a likelihood of inadvertent collision between the hook 109 and surrounding items. The hook may be guided into a desired position manually, semi-manually (i.e., computer assisted), or autonomously. It is contemplated that such functionality is beneficial to and applicable to both offshore operations and operations where one or both of the crane 100 or the object 103 is located onshore or on a platform. Thus, while methods and apparatus are described herein in context to offshore operations, onshore operations are also contemplated.

Figure 2:
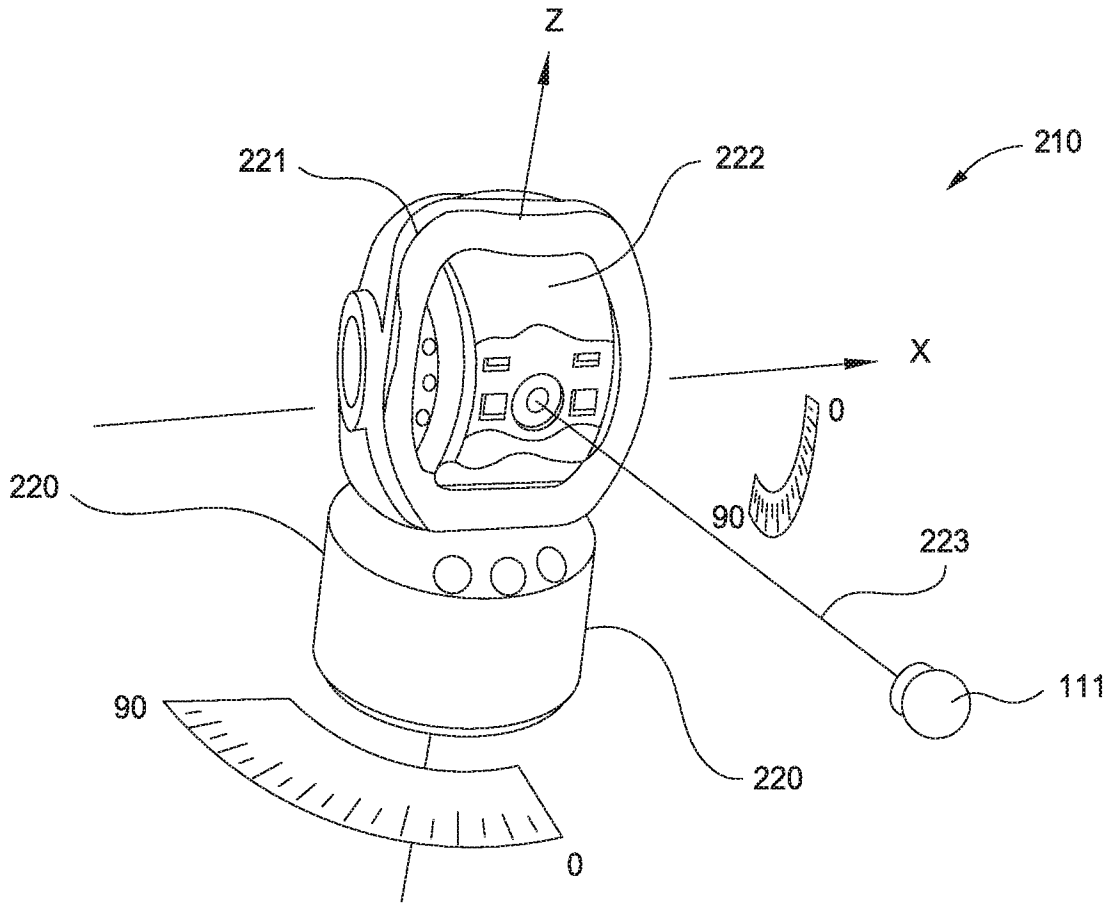
FIG. 2 is a schematic illustration of a target tracking device, according to one aspect of the disclosure.

FIG. 2 is a schematic illustration of a target tracking device 210 using a laser, according to one aspect of the disclosure. Exemplary laser trackers that may be utilized herein are the Vantage$^S$ and the Vantage$^E$, available from FARO Technologies UK Ltd., of Warwickshire, UK. It is to be understood that other laser trackers may be utilized.

The target tracking device 210 includes a base 220, a rotating mount 221, and an optical unit 222. The base 220 is configured to be mounted on a surface, such as the operator cab 105 of a crane 100. The rotating mount 221 is mounted on the base 220 and rotates about a vertical axis Z. The optical unit 222 is positioned within the rotating mount 221, and rotates therein about an axis X. The optical unit 222 includes a laser-generating source (not shown) therein which projects a laser 223 toward the optical target 111. The target tracking device 210 adjusts the relative positions of the rotating mount 221 and an optical unit 222 to continuously direct the laser 223 at the optical target 111 in response to movement therebetween. The laser 223 is reflected from the optical target 111, such as a spherically mounted retroreflector (SMR), and received by the optical unit 222 to facilitate determination of distance between the target tracking device 210 and the optical target 111. The optical unit 222 may also house one or more instruments therein, such as an accelerometer and/or an encoder, to determine a relative angle between the laser 223 and the vertical axis Z (or another axis). Information such as relative angle and distance to the optical target 111 are provided to a controller, such as controller 115, to perform calculations for active heave compensation or other operations.

In certain embodiments, the optical unit 222 of the target tracking device 210 may be replaced with an optical viewer, such as a camera system, which is configured to recognize the optical target 111. The target tracking device 210 may also use a combination of laser tracking and camera systems.

In one example, the target tracking device 210 has an optical viewer with a defined field of view. The optical target 111 is maintained in the field of view of the target tracking device 210. The relative position of the optical target 111 within the field of view of the target tracking device 111, and the changes in relative position of the optical target 111 over a period of time, are used by the target tracking device 210 to determine the relative motion between the first vessel and the second vessel and/or distance of the optical target 111 from the target tracking device 210. In a further example, two target tracking devices 210 with optical viewers are used. Each target tracking device 210 is directed towards the optical target 111. A controller compares the detected image from each target tracking device 210 to determine distance of the optical target 111 from the target tracking devices and/or relative motion of the optical target 111.

Figure 3A:
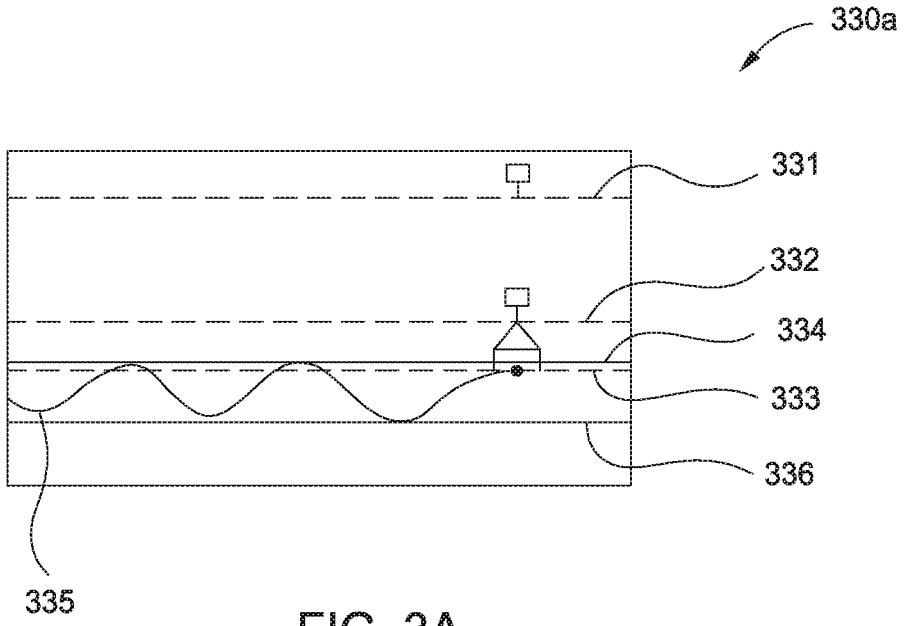
FIGS. 3A and 3B are schematic illustrations of data shown on a heads-up display (HUD), according to one aspect of the disclosure.
Figure 3B:
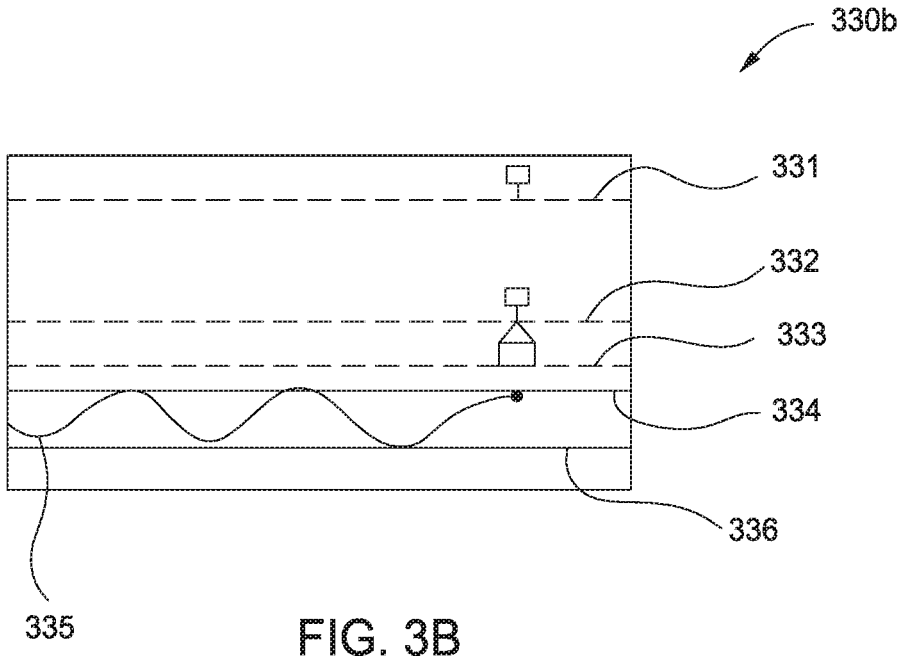

FIGS. 3A and 3B are schematic illustrations of data shown on heads-up displays (HUD), according to one aspect of the disclosure. FIG. 3A illustrates a HUD 330*a* during a lift-off operation, and FIG. 3B illustrates a HUD 330*b* during a landing operation.

In one aspect, data obtained by the target tracking device 110 is compiled and combined with other information from crane metrologies. In one example, the data obtained by the target tracking device 110 is compiled and combined with rope payout, boom angle, relative location of the carriage, or other data. The HUD is also configured to visually illustrate the ideal time to start a lifting or landing operation of the object 103 on the second vessel 104, or to direct operator control input, or to illustrate motion caused by the active heave compensator. The HUD may also display available hook height at a given location.

With reference to FIGS. 3A and 3B, the HUD 330*a* and the HUD 330*b* illustrate a hook stop position (e.g., maximum upward position of the hook) at line 331, a current hook position at line 332, and a lower contact point of the object 103 (shown in FIG. 1A) at line 333. The relative location of the landing or lifting surface fluctuates due to relative motion between the vessels, as illustrated by oscillating line 335. The maximum upward detected motion of the landing or lifting surface is shown at line 334 and the maximum downward detected motion of the landing or lifting surface is shown at line 336. The relative distance between the lines 335, 336 over a given time interval is used by the system to determine relative velocity between the load and the landing or lifting surface. In one example, the lines 332-336 are updated real time on the HUDs 330*a* and 330*b*. The information provided on the HUDs 330*a* and 330*b* assists an operator in performing landing and lift-off operations while mitigating inadvertent contact between a vessel deck and an object being landed thereon or lifted therefrom. Additionally, an operator can more easily visualize the relative positions of a vessel deck and an object being landed thereon or lifted therefrom. In certain embodiments, the relative velocity between the load and the landing or lifting surface, or relative distance therebetween, is used by the system to determine the optimal time to lift or land the load to prevent damaging impacts thereof. The relative velocity or relative location may also be used to control constant tension or the active heave compensator 112 to prevent impact of the load. Therefore, it is possible to further expand the operational window in which operations may be performed versus conventional methods.

For example, using aspects described herein, the relative velocity of both vessels can be accurately derived, thereby mitigating excessive derating by eliminating inaccurate visual estimates of wave heights or relative motions used in conventional methods. Moreover, using aspects described herein, relative motions are updated on a real-time basis, further ensuring operational windows are not exceeded due to changing atmospheric conditions but while still allowing operations to be performed at an upper boundary of an operational window.

Figure 4A:
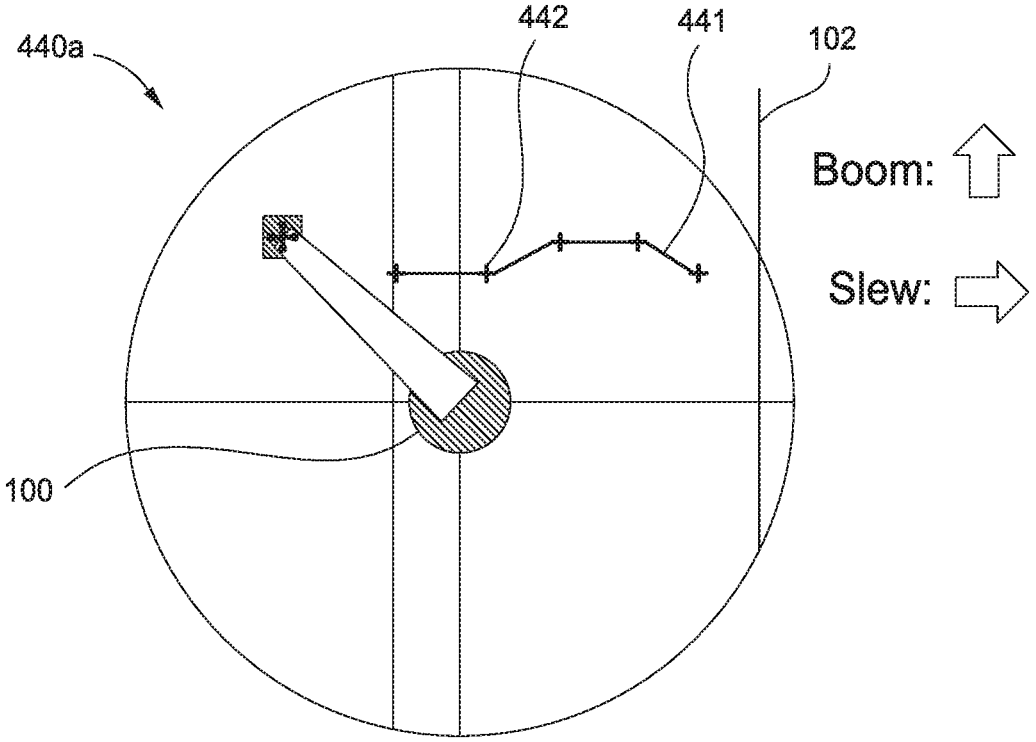
FIGS. 4A and 4B illustrate display information, according to aspects of the disclosure.
Figure 4B:
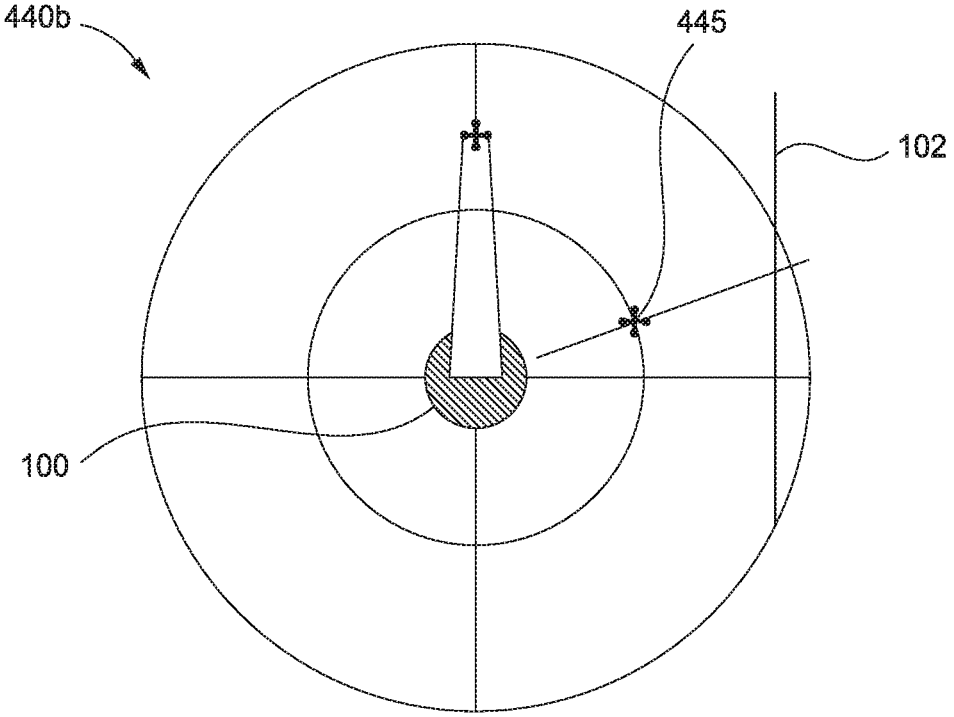

FIGS. 4A and 4B illustrate display information, according to aspects of the disclosure. As described above with respect to FIG. 1, a plurality of navigation points may be recognized and recorded by target tracking devices of the present disclosure. Such navigation points may be visible on a display visible to a crane operator. FIG. 4A is a representation of a display 440*a*. The display 440*a* schematically illustrates a top plan view of a crane 100 and the vessel 102. A travel path 441 is defined by a plurality of marked locations 442 (five are shown). Thus, a crane operator can easily visualize a desired path of a hook 109 (shown in FIG. 1B), and confirm that such a path 441 is being followed on the display 440*a*. It is contemplated that a controller may provide an operator with suggested boom and slew control to aid the operator in directing the hook 109 along the path 441. The path 441 may be selected to provide adequate clearance around objects, and thus, may allow a crane operator to navigate a hook into closer quarters than would be possible using conventional techniques.

FIG. 4B is a representation of a display 440*b*. The display 440*b* schematically illustrates a top plan view of a crane 100 and the vessel 102. The display 440*b* schematically illustrates a marked location 445 which indicates an objected to be lifted. The location 445 may be marked by an operator using a laser, or in another suitable manner. Additionally, the display 440*b* illustrates the radial distance from the crane 100 to the marked location 445, the lifting capacity of the crane at the radial distance, the lifting capacity of the crane 100 at the present location of the crane hook, and available hook height. It is contemplated that this and other information may be determined using aspects described herein, and displayed for operator usage on a display, such as display 440*b*. Thus, an operator can determine crane range and load accurately at any given location, without need to move the boom/hook of the crane 100.

Figure 5:
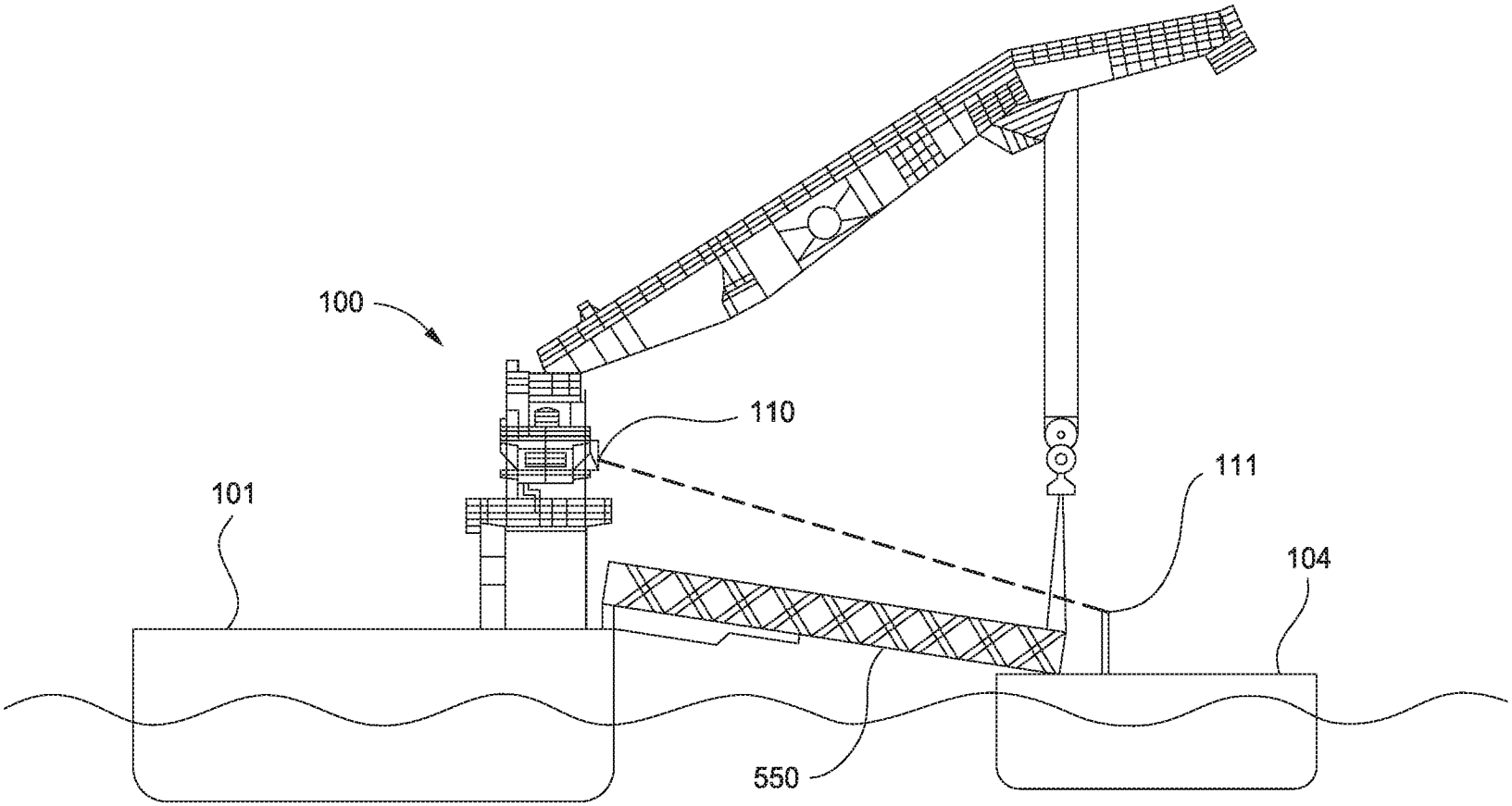
FIG. 5 illustrates a ship-to-ship walkway, according to one aspect of the disclosure.

FIG. 5 illustrates a ship-to-ship walkway 550, according to one aspect of the disclosure. The walkway 550 is suspended between a first vessel 102 and a second vessel 104. The walkway 550 is secured at a first end thereof to the first vessel 102. A second end of the walkway 550 is suspended over and adjacent to an upper deck of the second vessel 104 by a crane 100. An optical target 111 is positioned adjacent the second end of the walkway 550 on the second vessel 104 to be tracked by a target tracking device 110 as described above. As the second vessel 104 moves relative the first vessel 102, the crane 100 may utilize active heave compensation according to embodiments described herein to move the second end of the walkway 550 with minimized relative movement between the second end of the walkway 550 and the second vessel 104.

Figure 6:
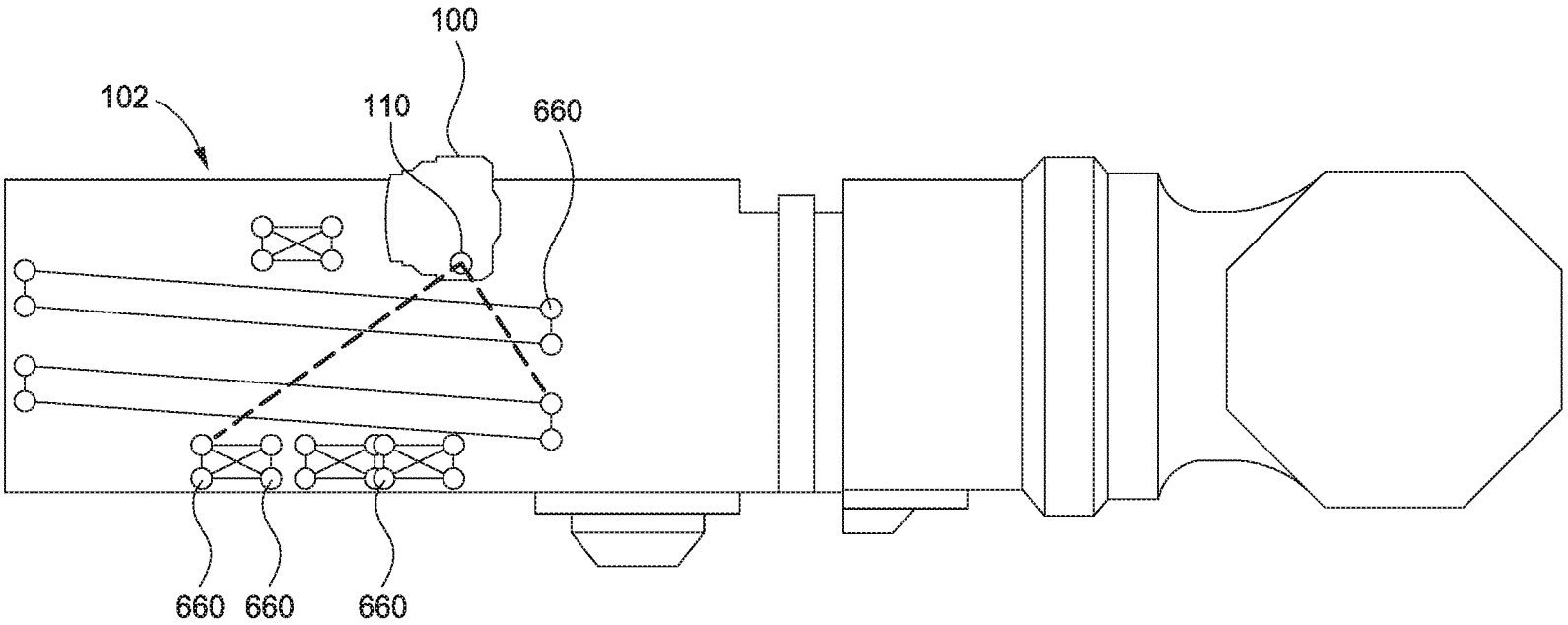
FIG. 6 is a schematic top plan view of a vessel having a crane thereon.

FIG. 6 is a schematic top plan view of a vessel 102 having a crane 100 thereon. Using aspects described herein, a target tracking device 110 (shown in FIG. 1B) is capable of determining a distance between the crane 100 and one or more designated locations 660 on the deck 101 the vessel 102. It is to be noted that the illustrated locations 660 are only examples, and many other locations 660 are amenable to distance determination using the target tracking device 110. The locations 660 are, for example, locations to land a load or locations where a load will be lifted from. A controller, such as controller 115, can recognize these locations prior to lifting or landing a load to predetermine the operation window for a particular lift. In another application, the controller may predetermine locations to land a load prior to transferring the said load the deck of the vessel 102. The controller can, for example, optimize the utilization of space on the deck for a given set of loads. Still further, an operator can indicate the locations 660 prior to landing a load therebetween. The indicated locations 660 can then be used to determine any necessary deck modifications to secure the load(s) thereto thereby saving modification time and costs. Still further, the locations may be safety barricaded to prevent entry thereto by personnel during the load lift thereby greatly improving safety.

In another embodiment, the target tracking device 110 is coupled to a laser indicator. The target tracking device 110 may irradiate a position, such as a landing location of a load, with the laser indicator for personnel to mark the position, such as locations 660. The locations 660 may be determined by the system as described above or coordinate points input into the system by an operator. Indicating such positions decreases the time necessary for personnel to manually measure locations using conventional means, such as, to determine the landing location of a load.

In addition, as described above, when ascertaining a distance from the crane 100 to a location 660, a display, such as the HUD 440*b* shown in FIG. 4B, provides to a crane operator a maximum crane lifting capacity and maximum hook height at the location 660. To facilitate display of the maximum crane lifting capacity and hook height at the location 660, an index or table stored in a memory containing such information may be referenced.

Benefits of aspects described herein include broadening of the "time-window" of favorable weather by allowing the crane to compensate dynamic vertical movement of both vessels. Thus, vessels using aspects described herein can operate in windows that are otherwise inoperable by conventional techniques. Additionally, the measurement systems described herein provide relative velocity that can be used as an assessment tool as to whether the motions between vessels are too great to perform a lift. Moreover, the determination of relative velocity allows a more specific selection of a derating curve, which conventionally required operators to use estimation. The estimation of operators in conventional techniques either did not allow utilization of full crane potential (by over-estimating relative velocity between vessels) or put operators in an unsafe operating window (by underestimating relative velocity).

Aspects of the disclosure provide additional advantages over conventional approaches. For example, by positioning a target tracking device on the operator cab, the target tracking device is able to track an optical target, and maintain the line of sight to the optical target even during a lift-off operation. The position of the target tracking device according to aspects described herein facilitates continued monitoring and determination of relevant motion between vessels throughout a lift-off operation. Therefore, if a lifted object and the vessel from which the object is lifted are in a state which cause "load slamming" the two to "slam" into one another during the lift, an alert can be provided to operator to address the situation, or alternatively, AHC may be employed, in response to target tracking measurements, to avoid a "slam" situation.

While the foregoing is directed to embodiments of the present disclosure, other and further embodiments of the disclosure may be devised without departing from the basic scope thereof, and the scope thereof is determined by the claims that follow.

What is claimed is:

1. A method for a first vessel having a crane thereon and a second vessel, the method comprising:

tracking an optical target mounted on the second vessel with a target tracking device positioned on the first vessel, wherein the target tracking device comprises a base mounted at a first position offset at a distance from a boom of the crane, a rotating mount mounted on the base and rotatable relative to the base, and an optical viewer mounted to the rotating mount and configured to recognize the optical target, wherein the base of the target tracking device is fixed at the first position connected to a deck of the first vessel during rotational movement of the crane such that movement of the optical viewer is independent of the rotational movement of the crane, and the optical target is mounted at a second position offset at a distance from an object to be lifted or landed;

producing data using the target tracking device in response to the tracking of the optical target;

determining a relative motion between the first vessel and the second vessel based on the data produced using the target tracking device;

determining one or more of a lifting capacity of the crane or an available hook height of a hook of the crane at a designated location, based on the relative motion, prior to moving the boom toward the designated location; and lifting or landing the object from or to the designated location.

2. The method of claim 1, wherein the data produced using the target tracking device indicates a distance between the target tracking device and the optical target.

3. The method of claim 2, wherein the data produced using the target tracking device indicates a relative angle between an axis and a line of sight from the target tracking device to the optical target, and the method further comprises displaying information on a display, the information indicating the relative motion between the first vessel and the second vessel, wherein the display is a heads-up display.

4. The method of claim 1, wherein the designated location indicates the object on the first vessel to be lifted.

5. The method of claim 1, wherein the designated location indicates a landing location on the second vessel for the object.

6. The method of claim 1, further comprising selecting a second target that defines a travel path of the hook of the crane.

7. The method of claim 6, further comprising displaying the travel path on a heads-up display.

8. The method of claim 3, further comprising:

determining a horizontal distance between a base of the crane and the designated location based on the data produced using the target tracking device; and displaying on the heads-up display one or more of the available hook height or the lifting capacity of the crane at the designated location prior to moving the boom toward the designated location, the designated location being adjacent the optical target located on the second vessel.

9. The method of claim 1, further comprising compensating for the relative motion between the first vessel and the second vessel in response to the data produced using the target tracking device.

10. The method of claim 1, wherein the object is an end of a ship-to-ship walkway.

11. The method of claim 1, wherein the rotating mount is rotatable about a first axis, the optical viewer is rotatable relative to the rotating mount and is rotatable about a second axis that extends perpendicularly to the first axis, and the optical target is mounted at the second position offset at a distance from a deck of the second vessel.

12. A method for a first vessel having a crane thereon and a second vessel, the method comprising:

tracking an optical target mounted on the second vessel with a target tracking device positioned on the first vessel, wherein the target tracking device comprises a base mounted at a first position offset at a distance from a boom of the crane, a rotating mount mounted on the base and rotatable relative to the base, and an optical viewer mounted to the rotating mount and configured to recognize the optical target, wherein the base of the target tracking device is fixed at the first position connected to a deck of the first vessel during rotational movement of the crane such that movement of the optical viewer is independent of the rotational movement of the crane, and the optical target is mounted at a second position offset at a distance from an object to be lifted or landed;

in response to the tracking, producing data using the target tracking device that indicates:

a distance between the target tracking device and the optical target; and a relative angle between an axis and a line of sight from the target tracking device to the optical target;

determining a relative motion between the first vessel and the second vessel based on the data produced using the target tracking device; and determining one or more of a lifting capacity of the crane or an available hook height of a hook of the crane at a designated location, based on the relative motion, prior to moving the boom toward the designated location; and lifting or landing the object from or to the designated location.

13. The method of claim 12, further comprising displaying information on a display, the information indicating the relative motion between the first vessel and the second vessel.

14. The method of claim 13, wherein the display is a heads-up display.

15. The method of claim 14, further comprising selecting a second target that defines a travel path of the hook of the crane.

16. The method of claim 15, further comprising displaying the travel path on the heads-up display.

17. The method of claim 14, further comprising:

determining a horizontal distance between a base of the crane and the designated location based on the data produced using the target tracking device; and displaying on the heads-up display one or more of the available hook height or the lifting capacity of the crane at the designated location prior to moving the boom toward the designated location, the designated location being adjacent the optical target located on the second vessel.

18. The method of claim 12, further comprising:

compensating for the relative motion between the first vessel and the second vessel in response to the data produced using the target tracking device; and performing the compensating while performing the lifting or the landing of the object.

19. The method of claim 12, wherein the optical target is an optical grid.

20. A system, comprising:

a crane;

a controller coupled to the crane;

an optical grid; and a camera, wherein the camera comprises a base mounted at a first position offset at a distance from a boom of the crane, a rotating mount mounted on the base and rotatable relative to the base, and an optical viewer mounted to the rotating mount and configured to recognize the optical grid, wherein the base of the camera is fixed at the first position connected to a deck of a first vessel during rotational movement of the crane such that movement of the optical viewer is independent of the rotational movement of the crane, and the optical grid is mounted at a second position offset at a distance from an object to be lifted or landed, wherein the camera is configured to track the optical grid and produce data in response to the tracking of the optical grid, the controller is configured to receive the data from the camera, and in response to receiving the data:

determine a relative motion between the optical grid and the camera based on the data produced using the camera, and determine one or more of a lifting capacity of the crane or an available hook height of a hook of the crane at a designated location, based on the relative motion, prior to moving the boom toward the designated location.

21. The system of claim 20, wherein the optical grid comprises a plurality of alternating shapes that are recognizable and distinguishable by the camera, the rotating mount is rotatable about a first axis, the optical viewer is rotatable relative to the rotating mount and is rotatable about a second axis that extends perpendicularly to the first axis, and the optical grid is mounted at the second position offset at a distance from a deck of a second vessel.

* * * * *